United States Patent [19]

Cunningham

[11] 4,085,015

[45] Apr. 18, 1978

[54] ELECTROLYSIS CELL LIQUOR EMISSION CONTROL PROCESS

[75] Inventor: Hugh Cunningham, Corpus Christi, Tex.

[73] Assignee: PPG Industries, Inc., Pittsburgh, Pa.

[21] Appl. No.: 788,876

[22] Filed: Apr. 19, 1977

Related U.S. Application Data

[62] Division of Ser. No. 713,451, Aug. 11, 1976, Pat. No. 4,045,324.

[51] Int. Cl.[2] ..... C25B 1/20; C25B 1/26

[52] U.S. Cl. ..... 204/98; 204/128

[58] Field of Search ..... 204/98, 128

[56] References Cited

U.S. PATENT DOCUMENTS 3,755,108 8/1973 Raetzsch et al. ..... 204/98

*Primary Examiner*—R. L. Andrews

*Attorney, Agent, or Firm*—Richard M. Goldman

[57] ABSTRACT

Disclosed is a bipolar electrolyzer having a plurality of individual electrolytic cells electrically and mechanically in series. Each of the cells has an anolyte chamber, a catholyte chamber, and catholyte liquor withdrawal means. A catholyte liquor trough is disposed along side the electrolyzer and beneath the catholyte liquor withdrawal means. The bipolar electrolyzer is characterized by apparatus for limiting the emission of catholyte liquor laden moisture from the cell liquor trough while simultaneously being capable of indicating a low catholyte liquor level in an individual electrolyte cell of the electrolyzer. Additionally, the apparatus may interrupt the flow of catholyte liquor between the catholyte chambers of the individual electrolytic cells and the catholyte liquor trough, thereby reducing corrosion of the perc pipes. The emission limiting means and low catholyte liquor level indicating means include a top on the cell liquor trough. The top of the cell liquor trough has recesses corresponding to the individual catholyte liquor withdrawal means. The recesses have apertures which communicate with the cell liquor trough at the intended level of cell liquor in the recess and second apertures communicating with the cell liquor trough below the first apertures.

2 Claims, 3 Drawing Figures

ELECTROLYSIS CELL LIQUOR EMISSION CONTROL PROCESS

This is a division of application Ser. No. 713,451, filed Aug. 11, 1976, now U.S. Pat. No. 4,045,324.

DESCRIPTION OF THE INVENTION

Alkali metal chloride brine, such as sodium brine or potassium chloride brine is electrolyzed to yield chlorine, hydrogen, and the corresponding alkali metal hydroxide, in a diaphragm cell. The diaphragm cell process is described in Sconce, Chlorine, Reinholt Publishing Co., New York, N.Y. (1962) at pages 81–126.

When the brine is sodium chloride the catholyte product may be an aqueous cell liquor which contains from 10 to 20 percent sodium chloride and from 5 to 15 percent sodium hydroxide. Alternative, in a permionic membrane cell process a catholyte product may be obtained that is from about 8 to about 44 percent sodium hydroxide and substantially free of sodium chloride. Typically, catholyte cell liquor is discharged at a temperature of from about 70° to about 115° C., although temperatures as high as 120° or even 125° C. may be encountered. When the cell liquor is discharged from the individual electrolytic cells through individual catholyte cell liquor recovery means, i.e., perc pipes, to a common cell liquor trough along the side of the electrolyzer, water vapor is given off. The water vapor contains entrained sodium hydroxide and sodium chloride.

The temperature at the catholyte liquor is high enough that the vapor pressure of water over the cell liquor trough is about 400 millimeters of mercury which results in high evaporative losses of water and entrained alkali metal hydroxide and alkali metal chloride. According to the method and apparatus of this invention, it is possible to reduce the high evaporative losses of sodium hydroxide and sodium chloride laden water vapor while providing a quick indication of problems in an individual cell. This is accomplished by providing a recessed cover on the cell liquor trough. The recesses are apertured recesses which allow pools of catholyte liquor to be maintained in the recesses during normal flow. The apertures are sized to allow overflow therethrough within the normal range of catholyte liquor flow and yet allow draining of the recesses and exposure of the apertures when the flow is interrupted. Additionally the apertures may be sized to allow interruption of the flow of cell liquor flow from the recess to the trough, e.g., pulsative flow. This may reduce the tendency of metal perc pipes to corrode.

According to the method of this invention, catholyte cell liquor is collected in the recess and overflows through the apertures to the trough during normal operation. During interrupted flow the apertures are exposed, allowing steam to escape thereby indicating the presence of problems in the individual electrolytic cell associated with the recess.

THE FIGURES

DETAILED DESCRIPTION OF THE INVENTION

Figure 1:
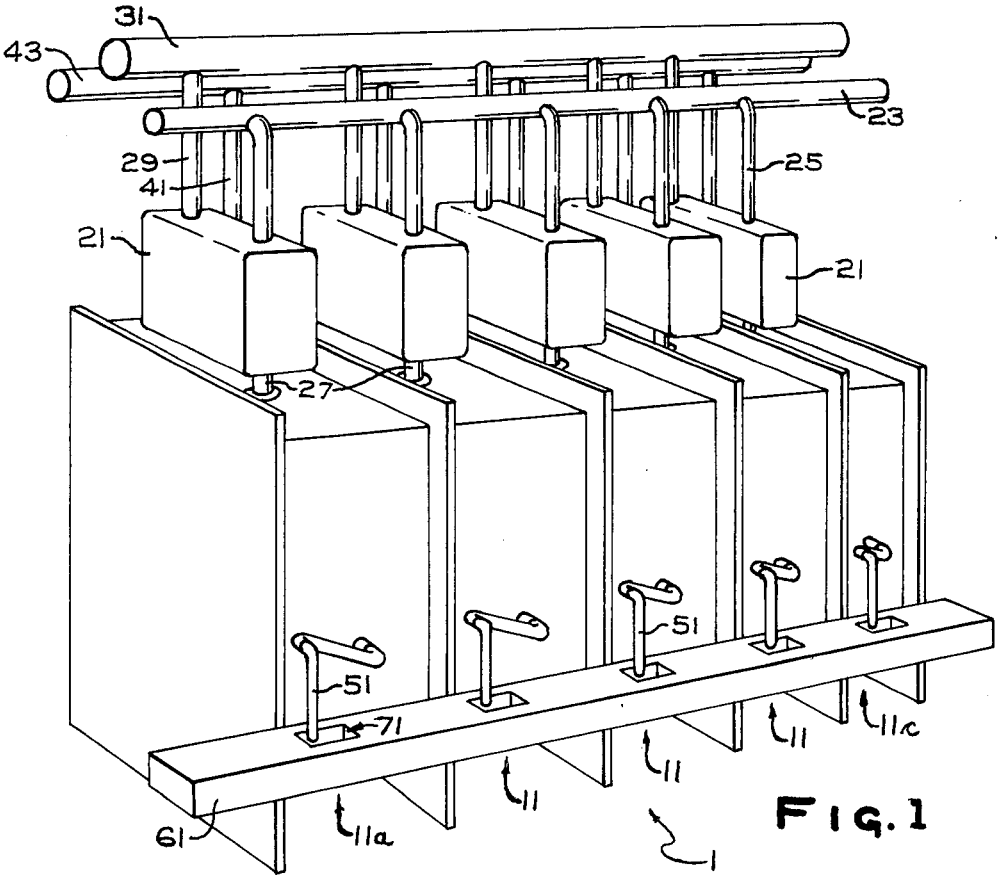
FIG. 1 shows a perspective view of a portion of an electrolyzer with cell liquor recovery means, i.e., perc pipes, and a cell liquor trough.
Figure 2:
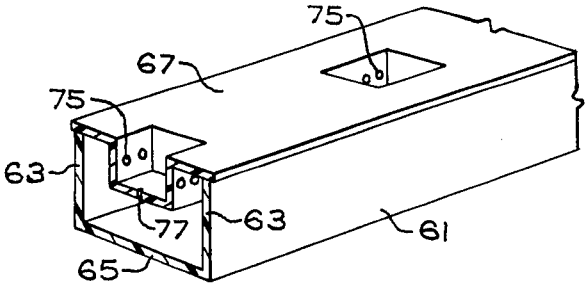
FIG. 2 shows a cell liquor trough with the side walls, top, a recess, first apertures in the sides of the recess, and second apertures in the bottom of the recess below the first apertures.
Figure 3:
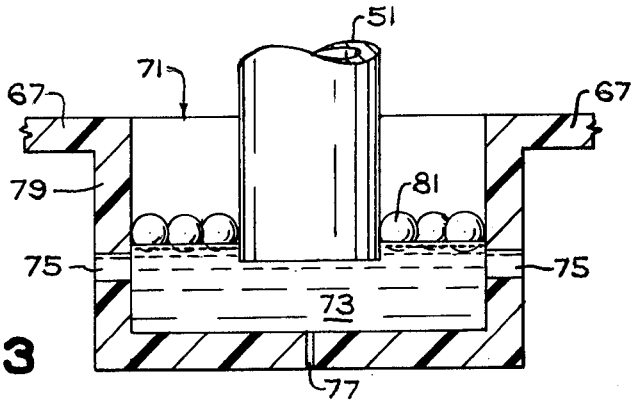
FIG. 3 shows another view of a cell liquor trough with the apertured recess having first apertures and second apertures, a perc pipe in communication with the recess, and a level of electrolyte indicated therein.

A bipolar electrolyzer 1 shown in FIGS. 1 and 2. The bipolar electrolyzer 1 has a plurality of individual electrolytic cells 11 electrically and mechanically in series, with an anodic end cell 11*a* at one end of the electrolyzer 1 and a cathodic end cell 11*c* at the opposite end of the electrolyzer. Intermediate cells 11 are between the anodic end cell 11*a* and the cathodic end cell 11*c* of the electrolyzer 1.

On top of the electrolyzer 1 are the brine tanks 21. Brine is fed from a brine header 23 through brine lines 25 to the brine tanks 21 and from the brine tanks 21 to the individual electrolytic cells 11. The brine tanks 21 also receive chlorine gas from the individual cells 11 through lines 27 to the brine tank 21 and discharge chlorine from the brine tank 21 through chlorine lines 29 to chlorine header 31.

Hydrogen is recovered from the individual cells 11 through hydrogen lines 41 to hydrogen header 43. Liquid catholyte product is recovered from the cells through catholyte recovery means, i.e., cell liquor perc pipes 51, to a cell liquor trough 61. The cell liquor perc pipes 51 are outlets from the catholyte chamber of the cells 11 and are adjustable to compensate for changes in diaphragm porosity over extended periods of electrolysis.

The cell liquor trough 61, along side of the electrolyzer 1, collects catholyte liquor from the perc pipes 51 of the individual cells 11. In the prior art, the catholyte cell liquor trough 61 has normally been open on top so as to allow for adjustment of the perc pipes 51. However, alternative perc pipes designs allow for head adjustment without substantial horizontal or vertical movement of the outlet.

According to the method of this invention, the cell liquor trough 61 is provided with side walls 63, a bottom 65, and a top 67. The top 67 includes recesses 71 therein.

The recesses 71 are apertured recesses, one recess corresponding to each perc pipe 51. The recesses 71 are deep enough to allow the perc pipe 51 to enter the recess 71 and to maintain a pool of catholyte cell liquor 73 in the recess. The pool of cell liquor 73 in the recess is maintained at a level such as to partially or completely cover the first aperture means 75 and to completely cover the second aperture means 77. Additionally, the size of the apertures, especially the first apertures 75, may be such as to periodically interrupt the flow of the liquor, thereby imparting a periodic or pulsative character thereto. This serves to reduce the flow of current from the perc pipe outlet to the trough 61, thereby reducing corrosion of the perc pipe 51.

Typically the recess is from about 1½ inch (3.8 cm) to about 4 inches (10.2 cm) deep and from about 3½ inches (8.9 cm) to about 6 inches (15.2 cm) in diameter. Where the recess is not of circular cross-section, it may be from about 10 inches (25.4 cm) to about 19 inches (48.3 cm) in perimeter. While the dimensions of the recess are not critical, the recess should have a capacity of from about 0.5 seconds to about 2 or more seconds of catholyte liquor flow from the perc pipe 51 under normal operating conditions. Capacities of less than about 0.5 seconds may make the recess 71 and the cell operation indication function of the recess too sensitive to minor transients while capacities in excess of 2 to 4 seconds may require too large of a recess 71. "Capacity," "residence time," and "holding time" as used herein are synonymous and mean the volume of the recess divided by the anticipated normal flow rate.

First aperture means 75 are at the intended level of cell liquor 73 in the recess 71. The first apertures 75 may be wiers circular openings in the side wall 79 of the recess 71 so as to maintain a constant level of cell liquor 73 in the recess 71 when operated in combination with the second apertures 77.

The second apertures 77 are below the level of the first apertures 75 and normally at the bottom of the recess 71.

The ratio of areas of the first apertures to the second apertures should be such that the bulk of the overflow of catholyte cell liquor out of the recess 71 into the cell liquor trough 61 is through the larger first aperture means 75. For example, the area of the first aperture means should be about 95 percent or even 99 percent or more of the total area of the apertures. Typically, the second aperture means 77 should have a discharge time of from about 2 to about 4 or more seconds in order to avoid the effect of transient interruptions of cell flow.

According to one exemplification of this invention, a cell liquor trough 61 is provided that is 8 inches wide by 4½ inches high serving a bipolar electrolyzer of eleven individual diaphragm electrolytic cells. The individual perc pipes 51 have a diamter of about 1/12 inches (3.8 cm) are inserted in recess 71 that are 3 inches (7.6 cm) deep by 5 inches (12.7 cm) in interior diameter. Each individual recess 71 has twelve 3/16 inch (.5 cm) diameter first apertures for a total area of first apertures 75 of 11.5 square inches (75 sq. cm). The first apertures 75 have their center line approximately 1 inch (2.5 cm) above the bottom of the recess 71 and approximately ½ inch (1.2 cm) below the intended level of catholyte cell liquor in the recess 71. The second aperture means 77 are provided by a single drain of 1/32 inch (0.8 mm) diameter whereby the second aperture means provides approximately 0.01 percent of the total aperture area.

According to the method of this invention, catholyte cell liquor passes from the catholyte liquor through the perc pipe 51 to the apertured recess 71 for a residence time of about 2 to 4 seconds. In the event of interruption of flow from a catholyte perc pipe the catholyte liquor flows out of the recess 71 first through the first aperture means 75 until the first aperture means 75 are exposed, as well as slowly through the second aperture means 77. When the first aperture means 75 are no longer covered by catholyte cell liquor 73, it is possible for water vapor within the cell liquor trough 61 to pass out of the cell liquor trough 61 through the first aperture means 75. The water vapor condenses upon contact with the cooler atmosphere providing the cell operator with a signal that the individual electrolytic cell corresponding thereto is not operating normally.

According to a further exemplification of this invention, plastic floats or balls 81 may be floated in each apertured recess 71 in order to further limit the evaporative loss of the catholyte cell liquor and the dispersion of alkali metal hydroxide and alkali metal chloride into the cell room.

While the invention has been described with reference to particular exemplifications and embodiments thereof, it is not intended to so limit the scope of the invention except as insofar as the specific details that are recited in the appended claims.

I claim:

1. In a method of electrolyzing alkali metal chloride brine in a bipolar electrolyzer containing a plurality of individual electrolytic cells electrically and mechanically in series, each of said cells being divided into an anolyte chamber and a catholyte chamber, which method comprises feeding alkali metal chloride brine to said cells, passing an electrical current through the individual electrolytic cells of said electrolyzer, recovering chlorine gas from said anolyte chamber, recovering catholyte cell liquor from the catholyte chambers of said cells through individual catholyte liquor recovery means, and collecting said catholyte liquor in a catholyte liquor trough extending alongside said bipolar electrolyzer below said individual catholyte liquor recovery means, the improvement comprising:

providing a top having recesses therein on said cell liquor trough, said recesses having first and second apertures, said first apertures being above said second apertures therein, each of said apertures draining electrolyte to the interior of said trough, each of said recesses corresponding to one of said individual catholyte liquor recovery means;

discharging catholyte liquor into said recesses whereby to maintain catholyte liquor in said recesses above said first and second apertures during the flow of catholyte liquor from said catholyte liquor recovery means, and to maintain the electrolyte level below said first apertures during the interruption of catholyte liquor flow from said catholyte liquor recovery means.

2. The method of claim 1 wherein said second apertures are in the bottoms of the recesses and first apertures are in the sides of said recesses.

* * * * *